US009278276B2

(12) United States Patent
Estopinal

(10) Patent No.: US 9,278,276 B2
(45) Date of Patent: Mar. 8, 2016

(54) RETRACTABLE ATHLETIC SURFACE

(71) Applicant: Robert Wayne Estopinal, Jeffersonville, IN (US)

(72) Inventor: Robert Wayne Estopinal, Jeffersonville, IN (US)

(73) Assignee: Robert Wayne Estopinal, Jeffersonville, IN (US)

( * ) Notice: Subject to any disclaimer, the term of this patent is extended or adjusted under 35 U.S.C. 154(b) by 0 days.

(21) Appl. No.: 14/791,677

(22) Filed: Jul. 6, 2015

(65) Prior Publication Data

US 2016/0008700 A1 Jan. 14, 2016

Related U.S. Application Data

(60) Provisional application No. 62/022,281, filed on Jul. 9, 2014.

(51) Int. Cl.

| | |
|---|---|
| ***A63B 69/00*** | (2006.01) |
| ***A63C 19/00*** | (2006.01) |
| ***E01C 13/00*** | (2006.01) |

(52) U.S. Cl.

CPC ..... *A63C 19/00* (2013.01); *E01C 13/00* (2013.01)

(58) Field of Classification Search

CPC ..... A63B 69/00; A63B 69/0013; A63B 2012/18; A63B 2012/182; A63B 2069/0006; A63C 19/00; A63C 19/02; A63C 19/08; A63C 19/10

USPC ..... 472/88–92; 473/497, 499

See application file for complete search history.

(56) References Cited

U.S. PATENT DOCUMENTS

| | | | | |
|---|---|---|---|---|
| 2,884,252 | A | 4/1959 | Thompson | |
| 3,508,747 | A | 4/1970 | Orsatti | |
| 3,628,789 | A * | 12/1971 | Suroff | A63C 19/10 104/58 |
| 4,591,154 | A | 5/1986 | Santarone | |
| 4,749,223 | A | 6/1988 | Goeders | |
| 5,213,323 | A | 5/1993 | Novinsky | |
| 5,467,977 | A | 11/1995 | Beck | |
| 5,618,131 | A | 4/1997 | Weber | |
| 5,624,112 | A | 4/1997 | Hummel et al. | |
| 5,707,305 | A | 1/1998 | Goeders et al. | |
| 5,716,295 | A | 2/1998 | Anglea | |
| 5,769,745 | A | 6/1998 | Bartoli | |
| 5,827,140 | A | 10/1998 | Bartoli | |
| 5,919,103 | A | 7/1999 | Bartoli | |
| 6,508,717 | B2 * | 1/2003 | Katayama | A63C 19/10 472/90 |
| 6,843,739 | B2 | 1/2005 | Putnam | |
| D520,094 | S | 5/2006 | Hess | |
| 7,090,586 | B1 * | 8/2006 | Everett | A63C 19/00 404/99 |
| 7,150,688 | B1 | 12/2006 | Coulbourn | |
| 7,344,459 | B2 | 3/2008 | Bykowsky | |
| 7,621,831 | B2 | 11/2009 | Roberts | |
| 7,927,238 | B2 | 4/2011 | Perez | |
| 8,157,678 | B2 | 4/2012 | Goeders | |
| 8,167,746 | B2 | 5/2012 | Massaro | |
| 8,216,095 | B2 | 7/2012 | Weber et al. | |
| 2004/0242352 | A1 | 12/2004 | Panus | |

* cited by examiner

*Primary Examiner* — Kien Nguyen
(74) *Attorney, Agent, or Firm* — Scott R. Cox

(57) ABSTRACT

A retractable athletic surface for use on an athletic field containing an opening within the athletic field into which a foundation is secured. Supporting the retractable athletic surface in the opening is a platform. A drive motor secured to the platform drives one or more systems for raising and lowering the platform within the opening. Upper and lower stops are secured to shaft stop assemblies which are present within slots inside walls of the foundation. These upper and lower stops support the retractable athletic surface in either a raised or lowered position.

16 Claims, 6 Drawing Sheets

RETRACTABLE ATHLETIC SURFACE

CROSS-REFERENCE TO RELATED APPLICATION

This Application claims benefit of Provisional Application No. 62/022,281, filed on Jul. 9, 2014.

STATEMENT REGARDING FEDERALLY SPONSORED RESEARCH OR DEVELOPMENT

Not applicable.

BACKGROUND OF THE INVENTION

The present invention relates to retractable athletic surfaces, particularly a retractable pitching mound or other athletic field fixture. More particularly, one aspect of the invention is a mechanical and/or electrical system for raising and lowering an athletic surface, such as a pitching mound, utilizing a drive motor to power screw jacks by drive shafts, such that a structure, preferably a steel platform, is supported on upper or lower stops in a raised or lowered position within, level with, or above an opening in an athletic field.

The investment of public/private funds in athletic facilities requires significant funds. Unfortunately, because such facilities are often designed as single-use facilities, there is a lack of flexibility in use of many of these facilities for different activities. An example of such lack of flexibility are athletic facilities containing elevated surfaces used for pitching mounds, bull pen mounds, track and field fixtures or areas, such as pits/water obstacles, etc. Because of the structure of these features of athletic facilities, the flexibility to use these venues for other purposes is limited. Further, the expense of manual conversion of these facilities for multiple uses is substantial. In addition, the potential for injury of athletes using converted sports facilities is significant, without a better control of the surface of the playing fields of these facilities.

The seasons of athletic teams often overlap, placing a premium on making a field playable in a short period of time for multiple uses. Accordingly, it is critical for a field to be convertible and playable within 24 hours from use for one sport to use for a different sport. Further, game scheduling is often conducted by league administration and is not under the control of the respective athletic teams, making quick modification of the surface of the athletic field often necessary.

The ability to raise and lower various ground level features of athletic field surfaces with minimal manpower and materials allows the surfaces to be converted from one use to another use efficiently and economically. This conversion ability also allows these venues to be more utilized and productive for multiple sports and the communities they serve. For example, such a conversion would allow a baseball playing field to be easily converted to use for football, soccer, band competitions and concerts.

For such conversions to be practical, there is a need for a system which will allow venues to use their primary playing surface without a tripping hazard that often occurs with raised or depressed athletic field features, such as pitching mounds. Efficient conversions of athletic surfaces also contribute to safety of use of such surfaces for participants.

Currently, removal of ground level and below ground level athletic field features involves many hours of labor and materials. For example, to manually remove a pitching mound from an athletic field to allow for a soccer game or concert involves manual labor using about 6 persons for approximately 7 hours each. This is very costly and results in many man-hours of labor. Additionally, the ability of grounds crews to manually reinstall fixtures with optimal consistency is difficult. A system that eliminates the need to reconstruct the fixtures resulting in a consistent surface, is needed. The retractable athletic surface/feature device disclosed herein reduces the labor needed for such conversion by approximately 80%.

Rather than manually removing and installing a raised or depressed surface, that surface can be mechanically or electrically raised or lowered and inexpensive filler soil or artificial inserts can be installed to level the surface. By utilization of this system, the total costs of this transformation of the surface can be substantially reduced.

BRIEF SUMMARY OF THE INVENTION

In an embodiment of one invention disclosed herein, a retractable athletic surface for use with an athletic field is disclosed which includes an opening within the athletic field, a foundation, preferably a concrete foundation, secured within the opening, a platform to support the athletic surface, which platform is located within the opening, one or more raising and lowering systems for raising and lowering the platform within the opening, which system or systems is secured to the foundation, a drive motor, preferably secured to the platform or support for the platform, to drive the raising and lowering system, and thereby raise and lower the platform within the opening, and upper and lower stops secured to or associated with the foundation which support the platform in a raised or lowered position within the opening.

Other objects and features of the invention disclosed herein will be apparent from the following detailed description and drawings.

DETAILED DESCRIPTION

Figure 1:
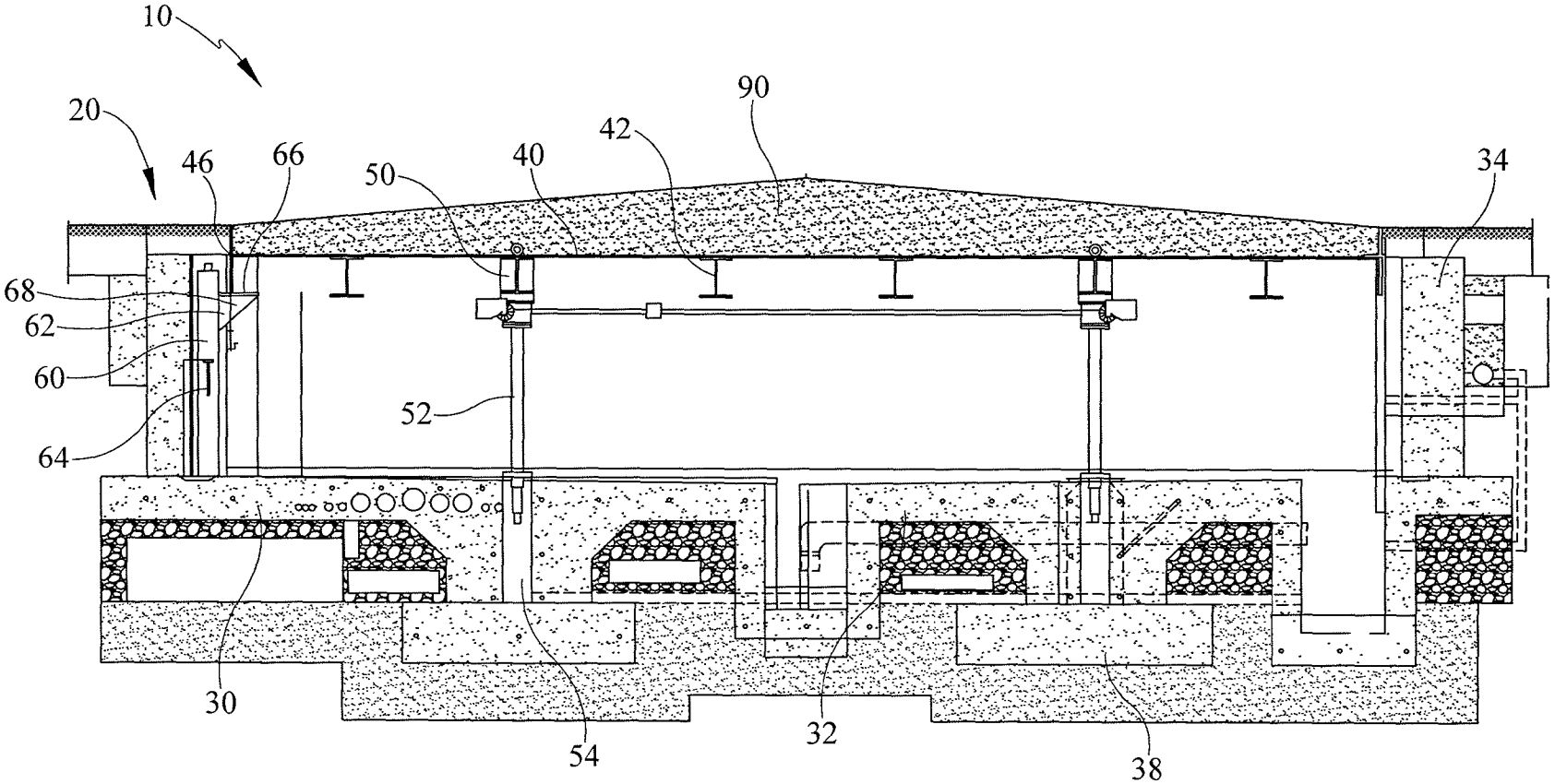
FIG. 1 is a cut away side view of a retractable athletic surface system used with a pitching mound, which mound is in a raised position.

One embodiment of an inventive concept disclosed herein is a retractable athletic surface (10) for use on an athletic field, which includes an opening (20) in the athletic field into which a foundation (30), preferably a concrete foundation, is introduced below and/or above a surface of the athletic field, as shown in FIGS. 1-6. The concrete foundation (30), as shown in FIGS. 1, 2 and 4-6, includes a concrete floor (32) with a concrete retaining wall or walls (34) secured to the floor which extend from the floor to or near to a surface of the opening (20) in the athletic field. Included as an element of the floor (32) may be a number of useful additional components that are present because the opening (20) extends below the surface of the athletic field. Such additional features may include, for example, a sump pump or other plumbing fixtures (not shown).

Present as an element of the concrete retaining wall (34) is one or more notches or slots (36) which are useful during raising and lowering the retractable athletic surface and are discussed later. (See FIG. 2.) Additional support for other features of the system may include one or more concrete slabs (38) in the floor (32) of the concrete foundation to support the system for raising and lowering the retractable athletic surface, as are discussed later. (See FIGS. 1 and 4). The thickness and depth of the concrete foundation may vary depending upon the needs of the individual user.

Figure 6:
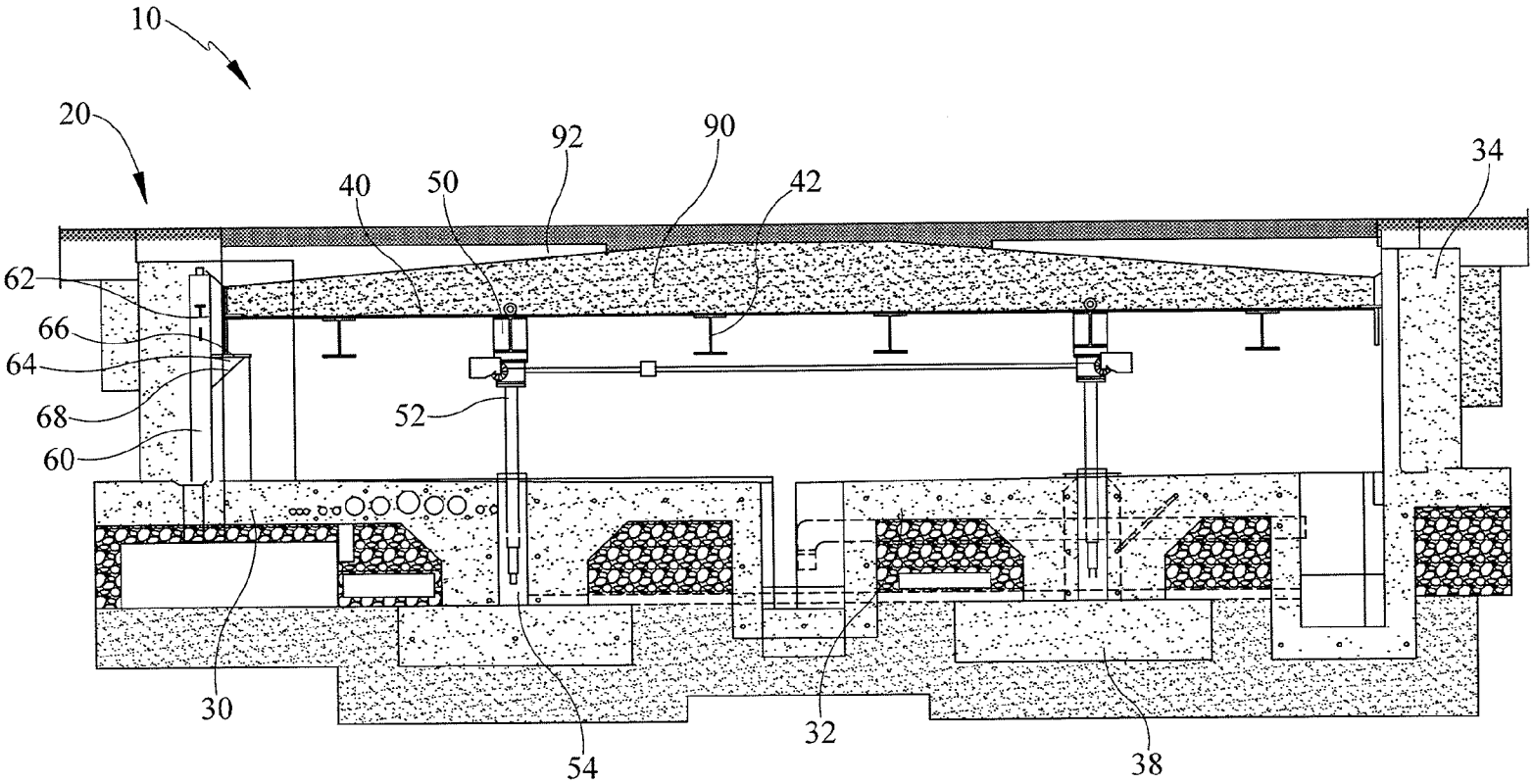
FIG. 6 is a cut away side view of the system of FIG. 1 showing the shaft stop assembly with upper and lower stops with the system in a lowered position.

An example of the retractable athletic surface (10) that can be raised and lowered within the opening (20) is a pitching mound (90), as shown in FIGS. 1 and 6. Alternatively and additionally, any type of athletic surface or athletic feature that requires modification in its height on or below the athletic field surface can utilize the disclosed system. For example, the disclosed system can also be useful for track and field features, such as water jumps, sand pits, landing zone mats or fixed hurdles.

Figures 3, 3A:
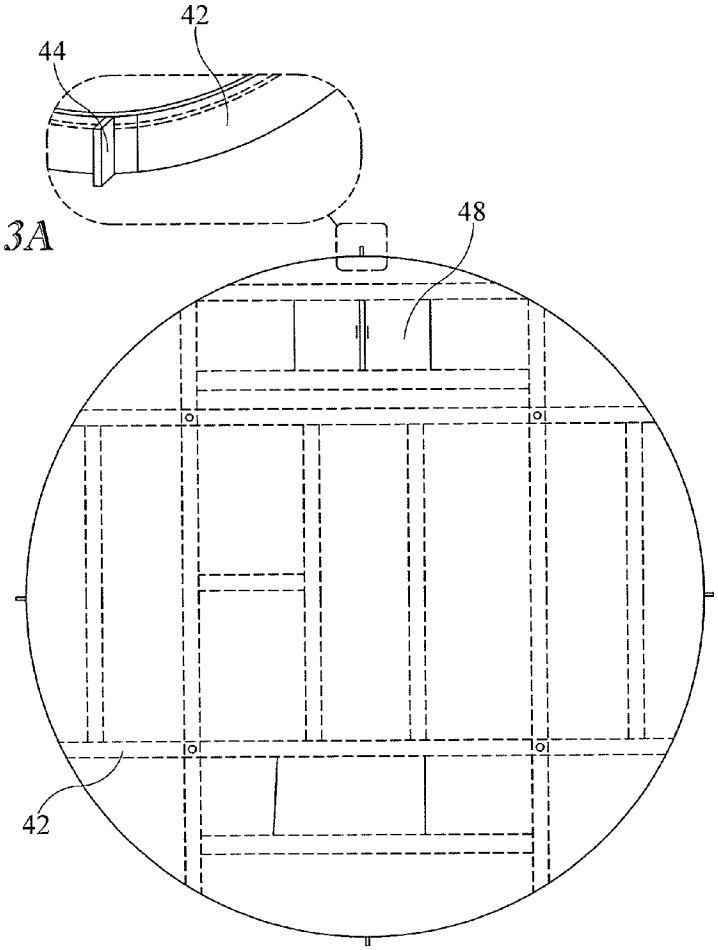
FIG. 3 is a top view of a support structure for supporting a platform of the system of FIG. 1.
FIG. 3A is a cut away perspective view of alignment guides secured to the support structure/platform of FIG. 3.

The retractable athletic surface is placed on and/or secured to a platform (40), preferably a steel platform, which is retractable within the opening (20) in the athletic field. (See FIG. 1.) This platform is supported by a support structure (42), preferably a steel support structure, such as is disclosed in FIG. 3. The particular shape, size, depth and structure of this support structure within the opening (20) can vary and have various shapes, sizes and depth depending upon the weight, height, size and location of the retractable athletic surface. An additional preferred feature of this platform (40) with support structure (42) is one or more alignment guides (44). These alignment guides may comprise steel extension elements that extend outward from an outside surface of the support structure as shown in FIG. 3A. These alignment guides may be secured to the platform and/or the support structure. The purpose of these alignment guides (44) is to better align and maintain the alignment of the platform (40) with support structure (42) within the opening (20) in the athletic field. These alignment guides (44) operate in conjunction with the concrete retaining wall (34) to maintain the proper level of the retractable athletic surface as it is raised and lowered within the opening (20) in the athletic field.

An additional feature that is associated with, or connected to, the platform (40) is a seal (46), particularly a rubber or neoprene seal, secured or anchored to the support structure (42). This seal, shown in FIGS. 1, 2, 5 and 6, assists in the prevention of moisture and debris entering the opening (20) in the athletic field.

Figure 2:
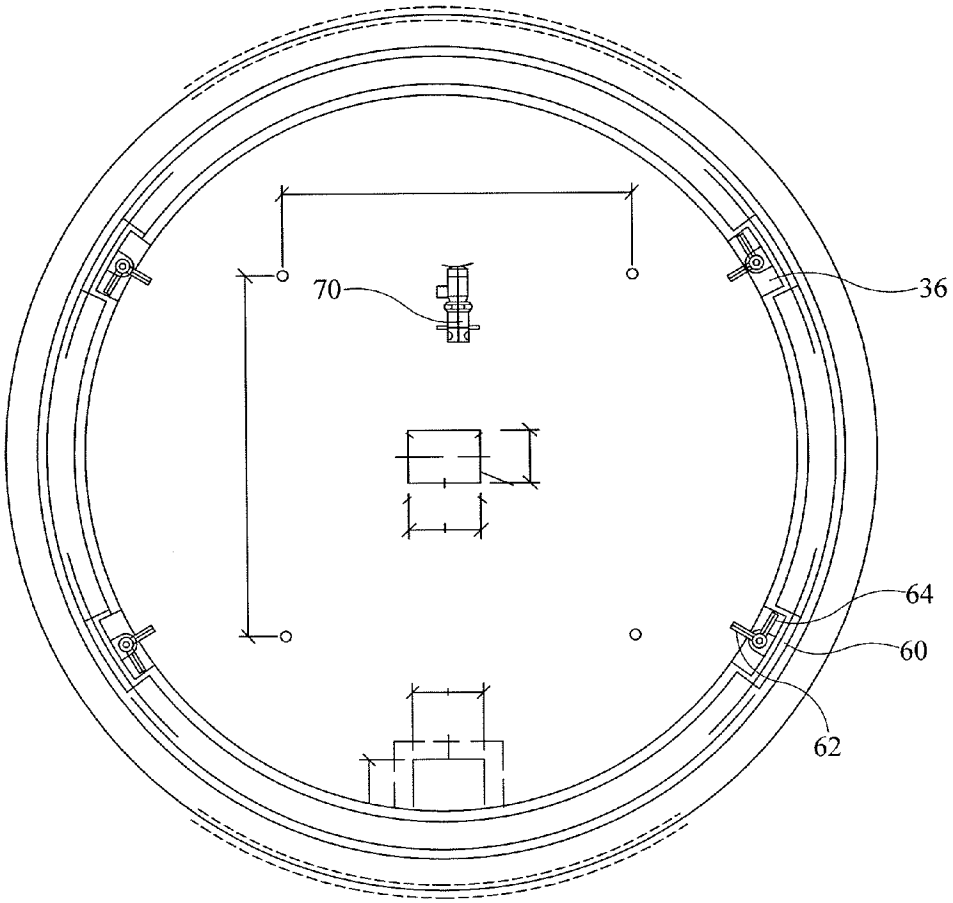
FIG. 2 is a top view of a drive motor secured within a concrete foundation with shaft stop assemblies of the system of FIG. 1.

One important element of this system for raising and lowering the retractable athletic surface includes well-known mechanical and/or electrical systems to raise and lower the retractable athletic surface. One such system, as shown in FIG. 2, is a drive motor (70), which electrically drives mechanical screw jacks (50), preferably at least four screw jacks, along their drive shafts (52) to raise and lower the retractable athletic surface. (See FIGS. 1 and 4.) The drive motor (70) is preferably connected to control wiring and a power supply at a remote location (not shown) so that the raising and lowering of the retractable athletic surface can be done remotely from said retractable athletic surface. Such wiring and power supply are preferably located underground and are not shown in the drawings, but are conventional.

Figure 4:
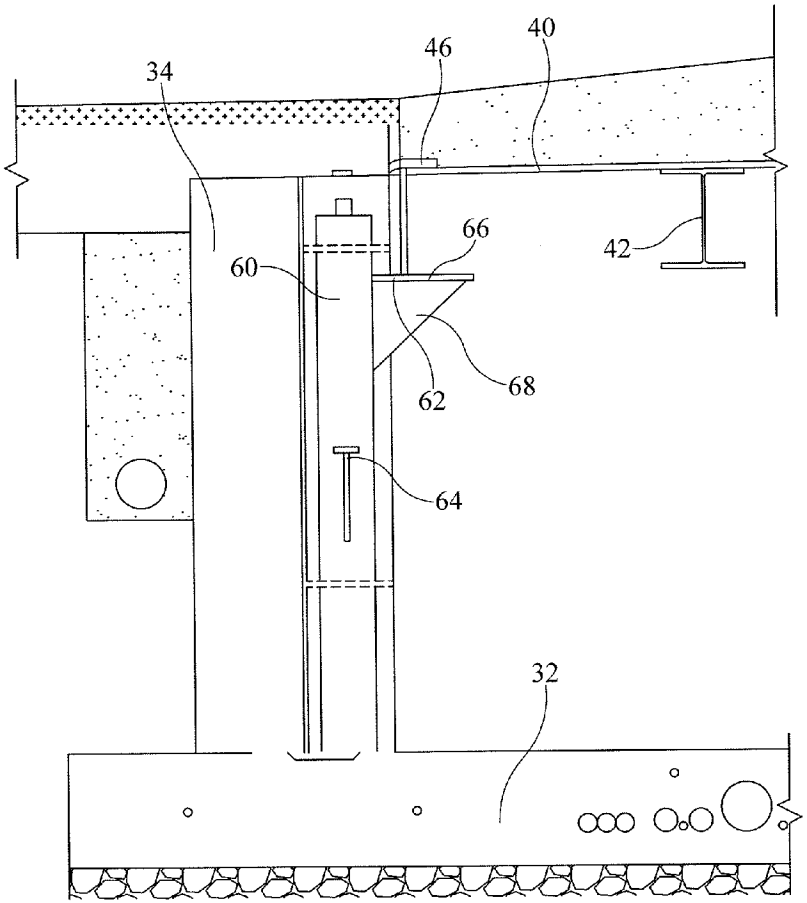
FIG. 4 is a cut away side view of the system of FIG. 1 showing a shaft stop assembly with upper and lower stops with the platform in a raised position.

The drive shafts (52), lowered by the mechanical screw jacks (50), preferably extend downward into a shaft (54) in the floor of the concrete foundation, which shaft receives the screw jacks. For example, compare the location of the drive shafts (52) within these shafts in the floor of the concrete foundation from the position of the pitching mound being in a raised position, as shown in FIG. 1, to a retracted position, as shown in FIG. 4.

The use of one electrically powered drive motor (70), instead of multiple motors, allows for ease of replacement and maintenance of the motor. Access to the motor is provided by an access panel (48) in the platform (40), as shown in FIG. 3. The screw jacks (50) are mounted on the underside or on an element of the steel platform (40) to keep the jacks away from any water that may accumulate on the floor (32) of a concrete foundation (30).

Figure 5:
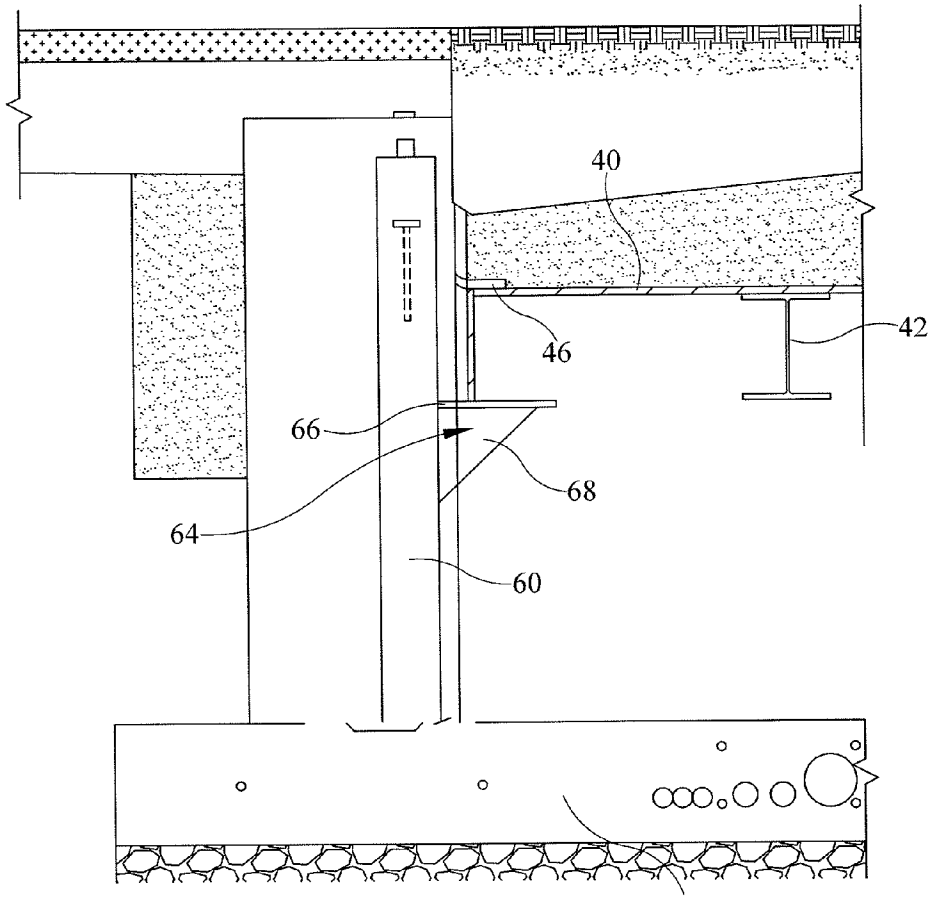
FIG. 5 is a cut away side view of the system of FIG. 1 showing a shaft stop assembly with upper and lower stops with the platform in a lowered position.

Various methods can be used to maintain the platform (40) at the proper height within the opening (20) in the athletic field. While the multiple mechanical screw jacks (50) themselves support the retractable athletic surface (10), an additional support for the retractable athletic surface may include the use of pins or stops located in or adjacent to the concrete retaining wall (34) of the concrete foundation (30). One embodiment utilizes one or more, preferably at least four, shaft stop assemblies (60) to which are attached an upper stop (62) and a lower stop (64). (See FIGS. 4 and 5.) In one embodiment these shaft stop assemblies are placed within notches (36) of retaining wall (34), as shown in FIG. 2. In the embodiment shown in FIGS. 4 and 5, each of the upper stop and the lower stop consist of a steel plate (66) supported by a triangular steel support (68), which is secured to the shaft stop assemblies (60). The shaft stop assembly is generally tubular in shape and rotatable around an internal pin which extends into or is supported by the floor (32) of the concrete foundation. The rotation of these shaft stop assemblies can be by mechanical or electrical means. The upper and lower stops (62, 64) have the same shape and are both secured to the respective shaft stop assemblies. In one embodiment, they are located approximately 90 degrees apart axially on the shaft stop assembly. By this location the shaft stop assembly can be rotated from a position where the upper stop (62) extends into the opening to support the platform (40), as shown in FIGS. 1 and 4, to a position where, after rotation of the upper, stop and lower stop counterclockwise, the lower stop (64) supports the platform and the upper stop is rotated inwardly and does not support the platform, as shown in FIGS. 5 and 6. A top view of the upper and lower stops on the four shaft stop assemblies within notches (36) is shown in FIG. 2.

The use of steel upper and lower stops (62, 64) allows for the platform (40) to be secured either in a raised or lower positions during events to reduce the possibility of the platform moving or swaying as heavy loads are applied to the platform. The rubber seal (46) is installed on top of the platform to limit penetration of water and debris into the concrete foundation area. Using this system, dead loads of significant weight can be used, even when filler soil is added when the platform is in a lowered position. Support of significant weight is critical to the performance of this system. Instead of the use of only filler soil, an insert (92), particularly a high density foam insert, may be inserted to cover a pitching mound (90), when it is in a retracted position, to reduce the weight on the retractable athletic surface (10).

In use when the retractable athletic surface (10), such as a pitching mound, is being used for baseball, the retractable athletic surface is secured in a raised position, such as is shown in FIGS. 1 and 4. Note that the platform and support structure for the platform (42) are supported by upper stops (62), which are secured to shaft stop assemblies (60). When the retractable athletic surface (10) is lowered, such as is shown in FIGS. 5 and 6, the platform (40) and support structure for the platform (42) are supported by the lower stops (64), which are also secured to the shaft stop assemblies (60). Note further that the drive shafts (52) of the mechanical screw jacks, when the platform is in a retracted position, extend into the shaft (54) in the floor (32) of the concrete foundation (54). Note also that a foam insert (92), preferably a high density foam, is placed on the pitching mound when in this retracted position and then atop this foam is placed conventional fill materials, such as sand, dirt and artificial turf, as shown in FIG. 6.

While several embodiments of the present invention have been shown and described, it is understood that many changes and modifications can be made thereto without departing from the scope of the inventions as disclosed herein.

The invention claimed is:

1. A retractable athletic surface system for use within an opening within an athletic field comprising a foundation secured within the opening;

a platform to support a retractable athletic surface, which platform is located within the opening;

a raising and lowering system for raising and lowering the platform within the opening, which system is secured to or supported by the foundation;

a drive motor to drive the raising and lowering system to raise and lower the platform within the opening; and upper and lower stops or pins secured to or associated with the foundation which support the platform in a raised or lowered position within the opening.

2. The retractable athletic surface system of claim 1 further comprising a support structure secured to the platform.

3. The retractable athletic surface system of claim 2 wherein the structure secured to the platform to support the platform further comprises alignment guides which assist in the alignment of the platform within the opening.

4. The retractable athletic surface system of claim 1 further comprising supports for the raising and lowering system secured within a bottom portion of said foundation.

5. The retractable athletic surface system of claim 1 wherein the raising and lowering system comprises one or more screw jacks designed to raise and lower the platform within the opening.

6. The retractable athletic surface system of claim 5 further comprising supports for the screw jacks comprising shafts present in a floor of the foundation.

7. The retractable athletic surface system of claim 1 wherein the retractable athletic surface comprises a pitching mound.

8. The retractable athletic surface system of claim 1 further comprising a rubber seal secured around an edge of the platform of the retractable athletic surface.

9. The retractable athletic surface system of claim 1 wherein the upper and lower stops or pins are secured to shaft stop assemblies secured within the foundation.

10. The retractable athletic surface system of claim 9 wherein the shaft stop assemblies are located within notches in a concrete retaining wall, which is a component of the foundation.

11. The retractable athletic surface system of claim 1 wherein the platform further comprises an access panel providing access through the platform to the drive motor.

12. The retractable athletic surface system of claim 1 further comprising control wiring and a power supply electrically connected to the drive motor and located outside of the opening in the athletic field.

13. The retractable athletic surface system of claim 1 further comprising a foam insert which covers the athletic surface when it is lowered into the opening by use of the raising and lowering system.

14. The retractable athletic surface system of claim 1 wherein the upper and lower stops are secured to a surface of a shaft stop assembly, wherein the shaft stop assembly has a tubular shape.

15. The retractable athletic surface system of claim 14 wherein the upper stop is secured to the surface of the shaft stop assembly at a location at least about 90 degrees rotationally from the position of the lower stop, which is also secured to the surface of the shaft stop assembly.

16. The retractable athletic surface system of claim 14 wherein the shaft stop assembly is secured within a slot in the sidewall of the foundation such that the upper stop or the lower stop extend inwardly within the opening upon rotation of the shaft stop assembly.

* * * * *